US007540114B2

(12) United States Patent
Dufour

(10) Patent No.: US 7,540,114 B2
(45) Date of Patent: Jun. 2, 2009

(54) CABLE TENSIONER

(75) Inventor: Fabien Dufour, Chateauneuf-sur-Loire (FR)

(73) Assignee: ArvinMeritor Light Vehicle Systems - France, Sully-sur-Loire (FR)

( * ) Notice: Subject to any disclaimer, the term of this patent is extended or adjusted under 35 U.S.C. 154(b) by 537 days.

(21) Appl. No.: 11/114,247

(22) Filed: Apr. 25, 2005

(65) Prior Publication Data

US 2005/0246961 A1 Nov. 10, 2005

(30) Foreign Application Priority Data

May 7, 2004 (FR) ..... 04 04942

(51) Int. Cl.
*E05F 11/48* (2006.01)

(52) U.S. Cl. ..... 49/352

(58) Field of Classification Search ..... 49/348, 49/349, 352, 360

See application file for complete search history.

(56) References Cited

U.S. PATENT DOCUMENTS 4,235,046 A 11/1980 Hess et al.
5,623,785 A 4/1997 Mariel
5,778,600 A * 7/1998 Chu ..... 49/352
6,038,817 A 3/2000 Scheck et al.

FOREIGN PATENT DOCUMENTS

| | | |
|---|---|---|
| DE | 197 06 866 | 9/1998 |
| EP | 0 244 303 | 4/1987 |
| GB | 716457 | 10/1954 |

OTHER PUBLICATIONS

French Search Report dated Jan. 31, 2005.

* cited by examiner

*Primary Examiner*—Jerry Redman
(74) *Attorney, Agent, or Firm*—Carlson, Gaskey & Olds

(57) ABSTRACT

A cable tensioner includes two cams mounted to face each other that pivot about a common spindle. A torsion spring is centered on the spindle. The torsion spring includes a first end in abutment with a first cam and a second end in abutment with a second cam. The torsion spring applies a torque onto each of the cams to reduce an angular distance between the cams when a cable exhibits insufficient tension. The cable tensioner is placed in a window regulator mechanism to simultaneously tension a lower cable and an upper cable of the device. Furthermore, the tension of one cable through the cable tensioner is reversible since the tension of each cable is balanced with the tension of the other cable.

8 Claims, 1 Drawing Sheet

CABLE TENSIONER

REFERENCE TO RELATED APPLICATION

This application claims priority to French Patent Application FR 04 04 942 filed on May 7, 2004.

BACKGROUND OF THE INVENTION

The present invention relates generally to a cable tensioner, in particular to a cable tensioner for a window regulator mechanism.

A window regulator mechanism is a device used in a motor vehicle to transmit a drive force to a window. A window regulator device includes a transmission device (such as a cable or a belt) that is connected to a drive device (such as a crank handle or a motor) which displaces the window. The window can be driven by sliders which move along guide rails under the action of the cable. The cable can include a lower cable and an upper cable wound in opposite directions on a drum that is driven by the motor or the crank handle.

The tension of the cable in the window regulator mechanism must be correctly controlled throughout the duration of its service life. Slack in the cable loop can cause inaccurate displacement of the window with respect to the instruction provided by the drive system.

The operational accuracy of the widow regulator mechanism is important and is particularly important in frameless door window regulator mechanisms. In certain models of frameless door window regulator mechanisms, the window lowers slightly when the door is opened to release itself from a roof seal. The displacement of the window must therefore be carried out accurately to not impede with the opening of the door. However, the displacement must not be too great in order to comply with official restrictions, in particular regulations regarding anti-pinching. The drive cable of the window must therefore have sufficient tension to guarantee an accurate displacement of the window.

The components forming the window regulator mechanism device progressively age, which apparently elongates the cable due, for example, to the wear of the drive drum and of the pulleys, the compression of the cable covers, or the creep of the pulleys. Cable elongation due to the aging of the various parts of the window regulator mechanism must be compensated for.

Mechanisms for taking up play are known that absorb the elongation of the cable to guarantee a tension in the cable that is sufficient for the correct functioning of the window regulator mechanism device. Most of these mechanism are systems that operate in a step by step mode, based on more or less fine notches, such as the one described in the patent DE 197 06 866 A.

To guarantee better regularity of the tension in the cable, it is preferable to employ a continuous take-up system which avoids threshold effects. Such a mechanism is described in the parent application EP-A-0 244 303 and includes a tensioner screw and nut having a force applied to it by a push rod and an elastic member. In one direction, the screw can, under the axial thrust of the elastic member, helically move in the nut each time the force applied by the push rod disappears or reduces. In the other direction, the screw cannot rotate or translate in the nut. This mechanism is an irreversible system based on friction. Therefore, when play is likely to occur between two parts associated with the tensioner screw, play is automatically compensated for when it appears by the unidirectional displacement of the screw.

The cable tensioners are disposed on a given cable path, that is on the lower cable or the upper cable of the window regulator mechanism device. The cable tensioners are generally placed on the lower cable of the window regulator mechanism, which is the "slack section" of the mechanism when the mechanism is at the end of upward travel. To tension the upper cable, it is necessary to provide another cable tensioner. However, this represents a significant cost overhead. The simultaneous tension of the lower cable and the upper cable makes it possible to balance the tension of one with respect to the other and eliminates any risk of the cables disengaging from their slides. The cable tensioners do not allow simultaneous tension of both the lower cable and the upper cable.

Moreover, the cable tensioners are irreversible systems. That is, when the unidirectional displacement screw has compensated for insufficient tension in the cable, it cannot carry out the reverse movement if there is excess tension on the cable. These mechanisms are well suited to compensate for permanent elongation of the cable due to aging of certain parts of the device. In certain cases, the cable can exhibit insufficient tension that is not permanent, but simply a temporary insufficient tension due, for example, to the stop of the window in the top or bottom position. If the cable tensioner compensates for such temporary elongation, the cable can subsequently have excess tension, which risks accelerating premature wear.

U.S. Pat. No. 4,235,046 discloses a cable tensioning mechanism designed to maintain the tension of a cable when the cable is driven in two opposite directions, that is to maintain the tension on the lower cable and on the upper cable. The mechanism includes a leaf spring having a semicircular shape in a rest state, and each end of the leaf spring includes a groove for engaging the cable. The leaf spring is centered by a fixing point on the drum for winding the cable sections. The leaves apply a force on each of the lower section and the upper section of the cable, and the leaf spring causes a local inversion of curvature of the cable. The leaf spring is, however, costly when it is dimensioned to induce a force sufficient to provide tension in the drive cable. In fact, the leaf spring must have rather long and largely dimensioned branches to not damage the cable by curvature inversions that are too great.

There is therefore a need for an inexpensive cable tension mechanism for a window regulator mechanism device which is not completely irreversible and which simultaneously tensions both the lower cable and the upper cable of the device.

SUMMARY OF THE INVENTION

The present invention provides a cable tensioner including two cams mounted to face each other and that pivot about a common spindle. A torsion spring centered on the spindle includes a first end in abutment with a first cam and a second end in abutment with a second cam. The torsion spring applies a torque onto each of the cams to reduce an angular distance between the cams when a cable exhibits insufficient tension.

According to embodiment, the cable tensioner includes a single spring. According to one embodiment, the two cams are identical. According to one embodiment, each cam is respectively disposed on a different cable path.

According to another embodiment, the spindle of the cams includes a shoulder in which the torsion spring is lodged. According to one embodiment, one end of the spring has an end-section lodged in one of the cams such that it is parallel with the spindle of the cams and of the torsion spring. According to one embodiment, one end of the spring has an end-section lodged on one of the cams such that it is perpendicular to the spindle of the cams and of the torsion spring. According to one embodiment, an angular distance between the two cams is variable between 190° and 45° under the action of the torsion spring.

The invention also provides a window regulator mechanism including an upper cable, a lower cable and a cable tensioner. The torsion spring compensates for the insufficient tension of one cable with the tension of the other cable. According to one embodiment, the upper cable bears against the first cam, and the lower cable bears against the second cam.

The present invention is used with an opening window or the like of a motor vehicle including a window regulator mechanism according to the invention.

These and other features of the present invention will be best understood by the following specification and drawings.

BRIEF DESCRIPTION OF THE DRAWINGS

Other features and advantages of the invention will become apparent on reading the following detailed description of embodiments of the invention, given by way of example only and with reference to the appended sole drawing in which.

DETAILED DESCRIPTION OF PREFERRED EMBODIMENTS

Figure 1:
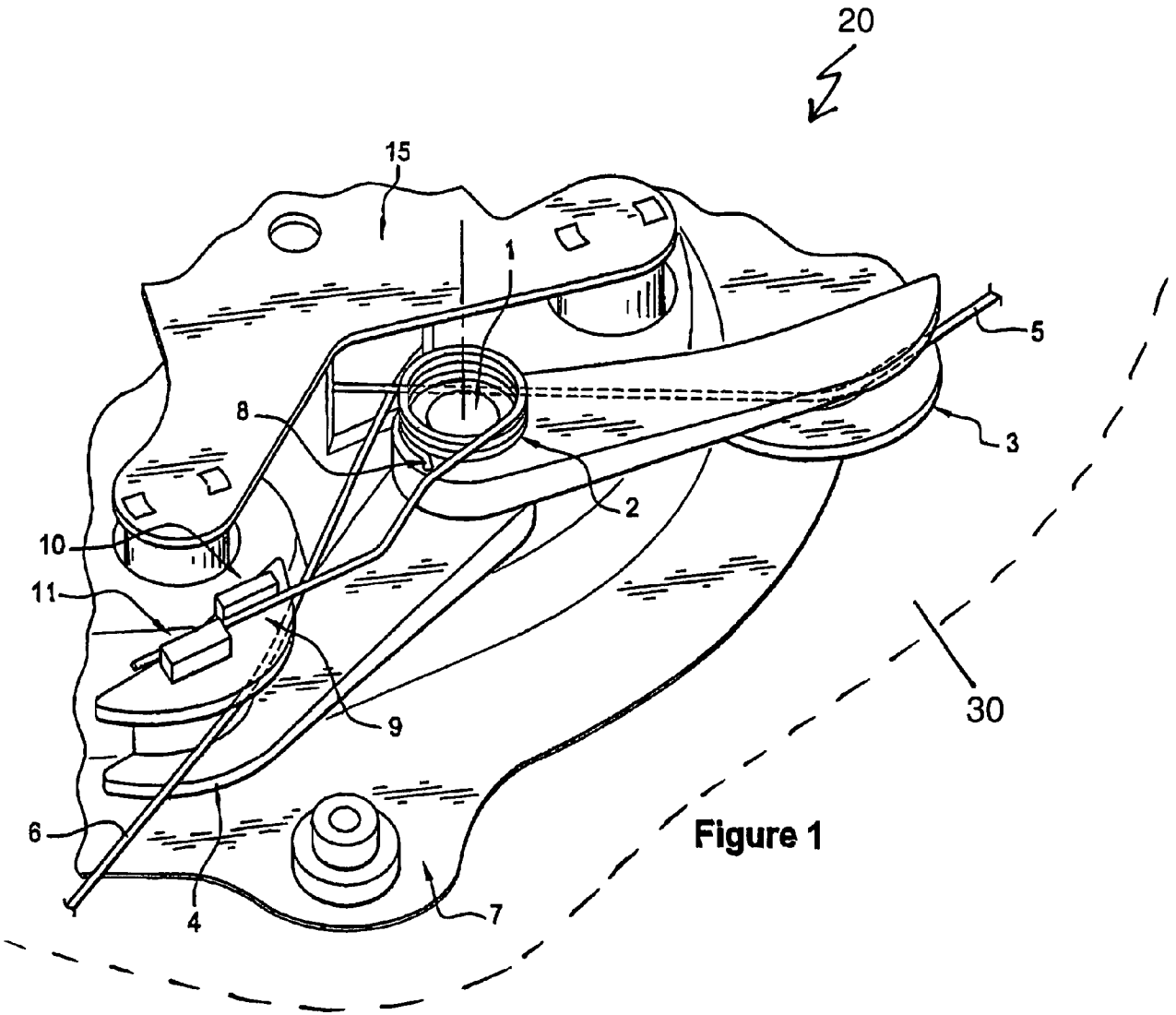
FIG. 1 shows a diagrammatic view of a cable tensioner according to the invention.

The cable tensioner according to the present invention includes two cams mounted to face each other and that pivot about a common spindle. A torsion spring centered on the spindle includes a first end that abuts against a first cam and a second end that abuts against a second cam. The torsion spring is designed to apply a torque on each of the cams to reduce an angular distance between the cams when one cable exhibits insufficient tension.

The cable tensioner according to the invention is intended to be placed in a window regulator mechanism to simultaneously balance the tensions of the lower cable and the upper cable of the device. Furthermore, the tension of one cable through the cable tensioner is reversible since the insufficient tension of one cable is balanced with the tension of the other cable.

The cable tensioner according to the invention includes a small tension spring associated with two identical cams. The torsion spring is much less expensive than the leaf spring disclosed in U.S. Pat. No. 4,235,046. Furthermore, the cams are arranged to apply a tension on the cables without any inversion of curvature.

The cable tensioner 20 of the invention will be described in detail with reference to the sole drawing. The cable tensioner 20 is a mechanism intended to be disposed in a window regulator mechanism 30 (shown schematically) to avoid insufficient tension in a cable of the device. As known per se, the window regulator mechanism 30 includes a plate 7 supporting a drive drum 15 upon which an upper cable 5 and a lower cable 6 are wound in opposite directions, making it possible to raise and lower the window, respectively. The upper cable 5 and lower cable 6 define a cable path which can includes slides, pulleys and return pulleys. As explained above, the tension of each cable 5 and 6 must be maintained sufficient at all times to prevent a malfunction of the window regulator mechanism 30, but nevertheless without excess tension to prevent premature aging of the components of the window regulator mechanism 30.

According to the invention, the cable tensioner 20 includes two cams 3 and 4 that are each on one of the cable 5 and 6, respectively. The cams 3 and 4 are mounted to face each other and pivot about a common spindle 1. The spindle 1 is integral with the plate 7, for example the spindle 1 is crimped on the plate 7. The cams 3 and 4 can be identical to each other to simplify the design, management, assembly and procurement of the parts of the window regulator mechanism 30. The cams 3 and 4 can be mounted on the spindle 1. That is, the cams 3 and 4 can be pre-fitted to the plate 7 with an automatic machine that provides a large gain in productivity in comparison with known tensioner systems with slides. The cams 3 and 4 each bear on one of the cables 5 and 6 and form an obtuse angle between them when the cables 5 and 6 are initially tensioned.

The cable tensioner 20 according to the invention also includes a torsion spring 2 mounted on the spindle 1 of the cams 3 and 4. The spindle 1 can include a shoulder (not shown), making it possible to house and axially retain the torsion spring 2. The torsion spring 2 is mounted such that it is compressed around the spindle 1, and two ends sections 8 and 9 bear against the cams 3 and 4, respectively. The torsion spring 2 thus applies a torque on each cam 3 and 4 that acts against the tension applied by each cable 5 and 6. When a cable 5 and 6 has insufficient tension, the moment of the torsion spring 2 becomes greater than the tension of the cable 5 and 6, and the torque applied by the torsion spring 2 on the corresponding cam 3 and 4 moves the cams 3 and 4 towards each other. This rotation of a cam 3 and 4 bearing on a stretched cable 5 and 6 re-tensions the cables 5 and 6. In fact, as the cams 3 and 4 bear on the cables 5 and 6, the movement of the cams 3 and 4 towards each other lengthens one of the cable 5 and 6. The angle formed by the cams 3 and 4 can be between 190° and 150° when the two cables 5 and 6 are tensed. The angle can be reduced to 45° under the action of the torsion spring 2.

According to the described embodiment, the torsion spring 2 includes the first end section 8 that bears against the cam 3 of the upper cable 5. The first end section 8 is lodged in a hole in the cam 3 that is parallel with the spindle 1 of the cams 3 and 4. The first end section 8 is off-centered with respect to the spindle 1, for example by 10 to 15 mm, to create a moment on an axis of rotation of the cam 3. Thus, when the upper cable 5 stretches and the tension applied by the upper cable 5 on the cam 3 reduces, the moment applied by the torsion spring 2 will drive the cam 3 to rotate and lengthen the path of the upper cable 5.

Furthermore, the torsion spring 2 includes a second end section 9 that bears on the cam 4 of the lower cable 6. The second end section 9 is lodged between two stop pieces 10 and 11 formed on the top of the cam 4. The second end section 9 is perpendicular to the spindle 1 of the cams 3 and 4 and creates a moment on an axis of rotation of the cam 4. Thus, when the lower cable 6 extends and the tension applied by the lower cable 6 on the cam 4 reduces, the moment applied by the torsion spring 2 will drive the cam 4 to rotate to lengthen the path of the lower cable 6.

The cable tensioner 20 according to the invention functions as follows. When the window regulator mechanism 30 lowers the window to a lowered position, the lower cable 6 has excess tension and the upper cable 5 has insufficient tension. The tension $P_{inf}$ of the lower cable 6 is of the order of 500N to 700N, depending on the maximum torque of the motors used in the window regulator mechanism 30. The tension $P_{inf}$ of the lower cable 6 is very much greater than the moment applied by the torsion spring 2. The cam 4, placed on the cable path of the lower cable 6, is therefore in a position of equilibrium in which the lower cable 6 pushes the cam 4 until it is tangential to the groove of the cam 4. Furthermore, the upper cable 5, which has insufficient tension in a bottom stop position, has a tension $P_{sup}$, which is less than the moment applied by the torsion spring 2. The cam 3, placed on the path of the upper cable 5, is therefore driven by the torsion spring 2 towards the other cam 4. The path of the upper cable 5 is thus lengthened by the movement of the cam 3, and the upper cable 5 is re-tensioned to an equilibrium tension. With the arrangement of the cams 3 and 4 and the torsion spring 2 shown, the lengthening of the cable path occurs without any inversion of curvature. Another arrangement could of course be envisioned.

When the window regulator mechanism 30 raises the window to a raised position, the lower cable 6 relaxes and the upper cable 6 becomes tensioned again. The cable tensioner 20 according to the invention therefore makes it possible to balance out the tension of one cable with respect to the other cable with constant equilibrium. Depending on the tension in each of the cables 5 and 6, the cams 3 and 4 (disposed on each respective cable path) move towards each other to a greater or lesser degree under the action of the torsion spring 2. The cable paths are therefore continuously adapted to guarantee optimal tension in each cable 5 and 6 without the risk of excess tension or disengaging the cables.

When the window regulator mechanism 30 is against a top stop position, the upper cable 5 has excess tension and the lower cable 6 has insufficient tension. The tension $P_{sup}$ of the upper cable 5 becomes much greater than the moment applied by the torsion spring 2. The cam 3, placed on the upper cable 5 path, is placed in a position of equilibrium, with the upper cable 5 tangential to the groove of the cam 3. Furthermore, the lower cable 6 has insufficient tension and exhibits a tension $P_{inf}$ that is less than the moment applied by the torsion spring 2. The cam 4, placed on the lower cable 6 path, is therefore driven by the torsion spring 2 towards the other cam 3 to lengthen the path of the lower cable 6 to retension it to an equilibrium tension.

The cable tensioner 20 according to the invention is designed to balance out, with a single torsion spring 2, the insufficient tension of one cable with the tension of the other cable and to take up, by a reduction of the angular distance between the cams 3 and 4, any undesirable elongation of the loop of the cables 5 and 6. The rotation of one of the cams 3 and 4 under the action of the torsion spring 2 can possibly take up as much as 100 mm of elongation of the loop of a stretched cable 5 and 6.

The cable tensioner 20 according to the invention is particularly suitable for being disposed in a cable path of a window regulator mechanism 30, but can equally well be adapted to any other cable driven remote control device requiring compensation for play. An advantageous application of the invention therefore relates to the opening windows of a motor vehicle, and in particular to frameless doors.

The present invention is of course not limited to the embodiments described by way of example. Thus, the torsion spring 2 has been shown with one end-section parallel with the spindle 1 of the cams 3 and 4 and one end-section perpendicular to the spindle 1 of the cams 3 and 4. It is however understood that other designs of torsion spring 2 can be used, for example having two perpendicular end sections, one above a first cam and the other below a second cam. Any design of the torsion spring 2 designed to apply a torque simultaneously to both concentric cams 3 and 4 can be used to implement the invention.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A cable tensioner comprising:

a first cam and a second cam mounted to face each other and pivot about a common spindle; and a torsion spring centered on the common spindle, the torsion spring including a first end in abutment with the first cam and a second end in abutment with the second cam, wherein the torsion spring applies a torque onto each of the first cam and the second cam to reduce an angular distance between the first cam and the second cam when a cable exhibits insufficient tension.

2. The cable tensioner according to claim 1, wherein the torsion spring is a single spring.

3. The cable tensioner according to claim 1, wherein the first cam is disposed on a first cable path and the second cam is disposed on a second cable path different from the first cable path.

4. The cable tensioner according to claim 1, wherein the common spindle includes a shoulder in which the torsion spring is lodged.

5. The cable tensioner according to claim 1, wherein the torsion spring includes an end section that is lodged in one of the first cam and the second cam and parallel with the common spindle and the torsion spring.

6. The cable tensioner according to claim 1, wherein the torsion spring includes an end section that is lodged on one of the first cam and the second cam and perpendicular to the common spindle and the torsion spring.

7. The cable tensioner according to claim 1, wherein the angular distance between the first cam and the second cam is variable between 190° and 45° under an action of the torsion spring.

8. The cable tensioner according to claim 1, wherein the first cam and the second cam are separate components.

* * * * *